United States Patent [19]

Hoeffken

[11] Patent Number: 4,893,390

[45] Date of Patent: Jan. 16, 1990

[54] METHOD AND EXPANDER FOR MANUFACTURING A FURNACE HEAT EXCHANGER AND PLATE ASSEMBLY

[75] Inventor: Russell W. Hoeffken, Belleville, Ill.

[73] Assignee: Snyder General Corporation, Red Bud, Ill.

[21] Appl. No.: 239,348

[22] Filed: Sep. 1, 1988

[51] Int. Cl.[4] ..... B21D 53/00; B21K 29/00; B23P 15/26

[52] U.S. Cl. ..... 29/157.3 R; 29/157.5; 29/512; 29/523; 29/243.52; 72/355; 72/393

[58] Field of Search ..... 29/512, 523, 157.5, 29/727, 243.52, 157.3 R; 72/355, 393

[56] References Cited

U.S. PATENT DOCUMENTS

| | | | |
|---|---|---|---|
| 2,357,123 | 8/1944 | Maxwell | 72/393 |
| 2,481,628 | 9/1949 | Sherman | 72/393 |
| 2,654,413 | 10/1953 | Weidel | 72/393 |
| 3,260,097 | 7/1966 | Hilton | 72/393 |
| 3,385,087 | 5/1968 | Huth | 72/393 X |
| 3,757,717 | 9/1973 | Bennett | 29/512 X |
| 3,940,837 | 3/1976 | Wiese | 29/157.5 |
| 4,416,142 | 11/1983 | Thorne-Thomsen | 72/355 X |
| 4,663,837 | 5/1987 | Hoeffken | 29/727 |
| 4,706,487 | 11/1987 | Bandou et al. | 72/355 |

*Primary Examiner*—Charlie T. Moon

*Attorney, Agent, or Firm*—Rogers, Howell & Haferkamp

[57] ABSTRACT

A furnace heat exchanger and support plate assembly are joined together by a cooperating substantially elliptical rim defining an opening in the heat exchanger and an opening formed by a mating flange on a partition plate and extending perpendicular to the plane of the plate. The flange and the partition plate is inserted in the opening in the heat exchanger unit and expanded radially outward with respect to the central longitudinal axis of the openings by a multiple jaw expander mechanism which is inserted through the opening in the plate into the interior of the heat exchanger. The expander includes radially and axially moveable jaws comprising plural jaw segments which are engaged by an axially moveable mandrel. The number of jaws in the expander is sufficient to form a substantially leakproof seal between the exchanger unit and the support plate assembly in a single expander operation through a single bending sequence.

19 Claims, 3 Drawing Sheets

FIG. 4.
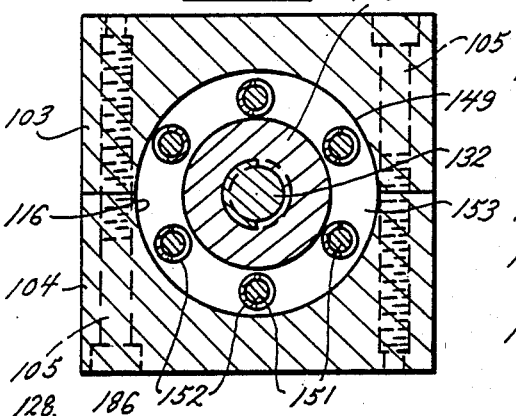
FIG. 5.
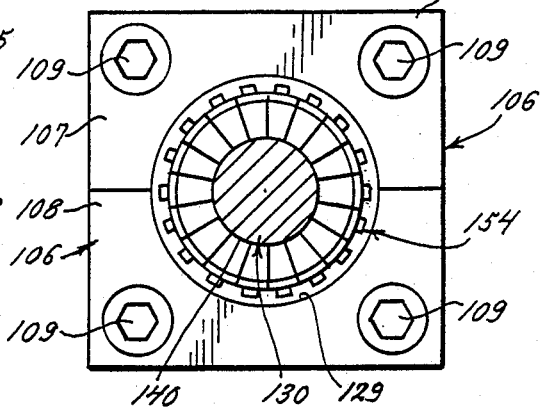
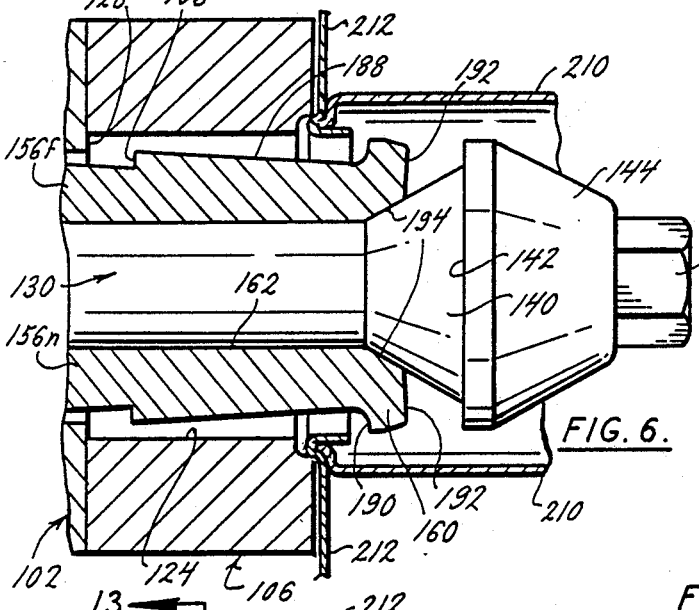
FIG. 6.
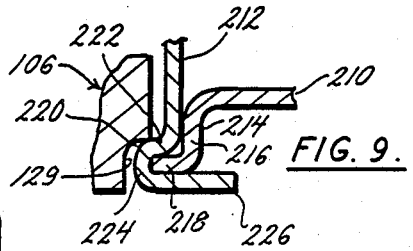
FIG. 9.
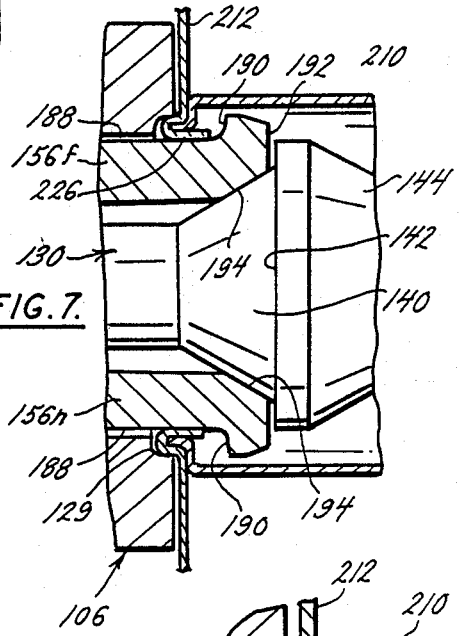
FIG. 7.
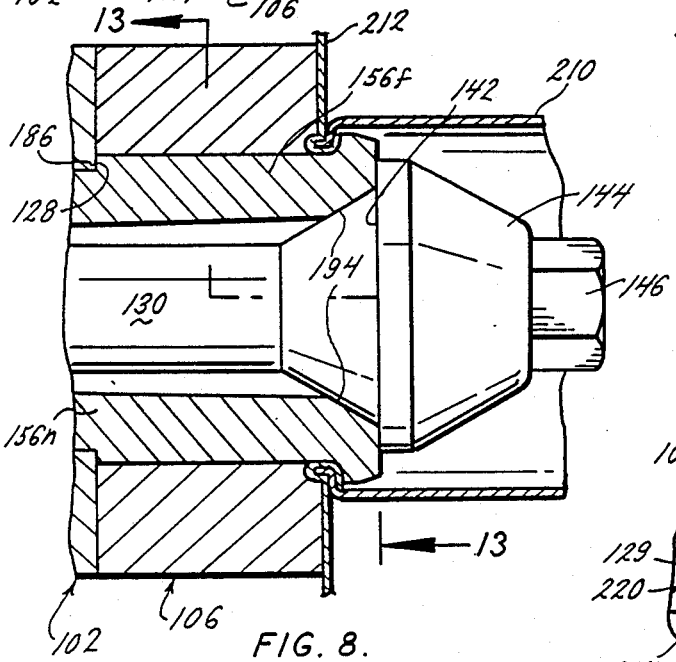
FIG. 8.
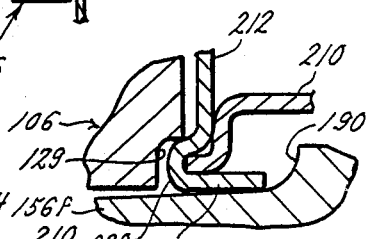
FIG. 10.
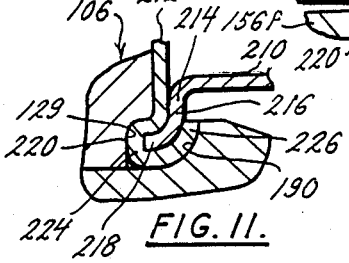
FIG. 11.

FIG. 13.
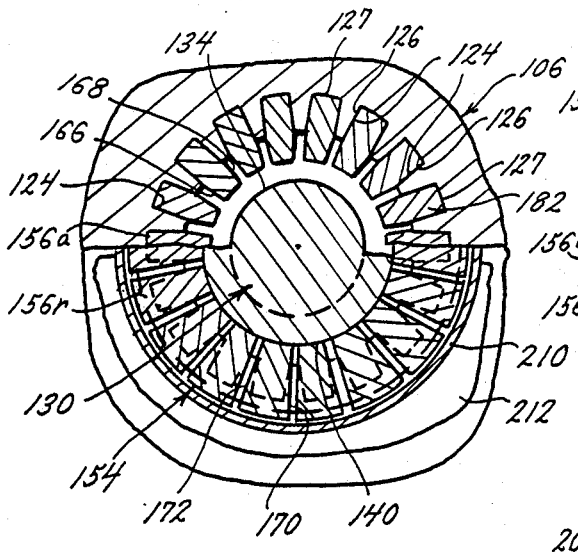
FIG. 12.
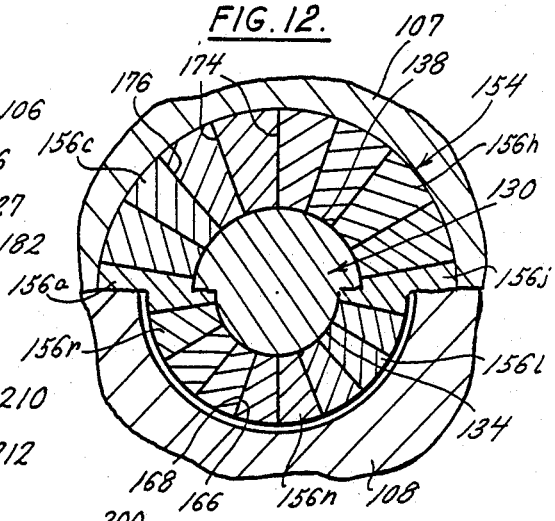
FIG. 14.
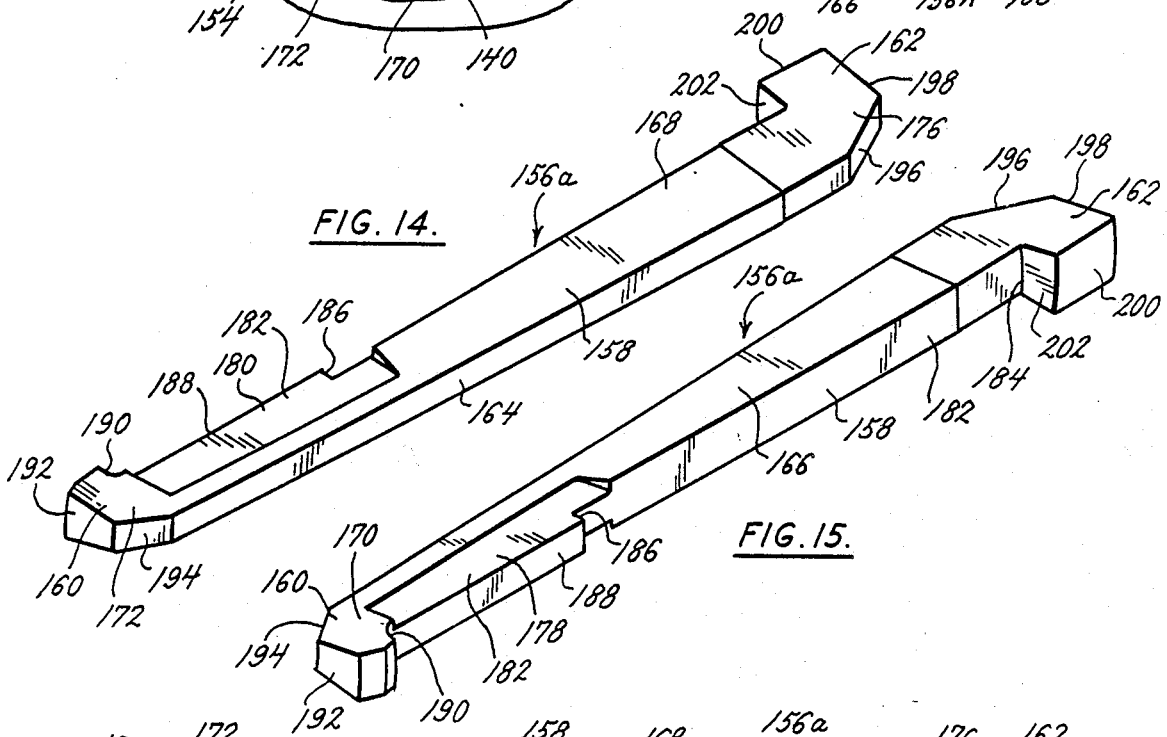
FIG. 15.
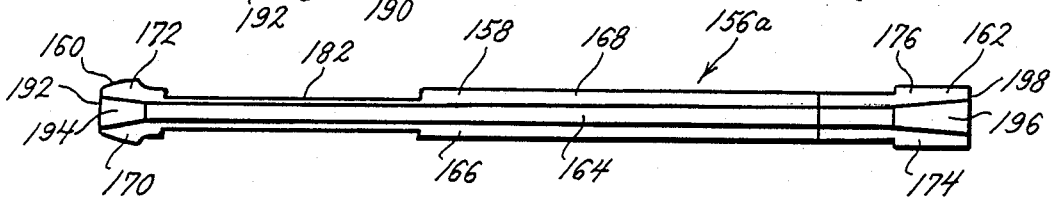
FIG. 16.

METHOD AND EXPANDER FOR MANUFACTURING A FURNACE HEAT EXCHANGER AND PLATE ASSEMBLY

BACKGROUND OF THE INVENTION

1. Field of the Invention

This invention pertains to an expander for forming a continuous fluid-tight joint between a heat exchanger and a support plate in a single operation of the expander.

2. Background

A heat exchanger typically has a plurality of heat exchanger units or section, a burner inlet opening and a flue gas outlet opening. A partition plate, typically part of the furnace housing, has openings corresponding to, and aligned with the burner and flue gas openings in the heat exchanger and one or more of the heat exchanger parts are joined to the partition plate by an assembly means. This assembly means must create a fluid-tight seal between the peripheral edges surrounding the partition plate openings and the peripheral edges of the burner inlet and flue gas outlet openings in the heat exchanger unit.

In U.S. Pat. No. 3,940,837 to John M. Wiese and assigned to the assignee of the present invention, a heat exchanger part is formed of opposed clamshell sections having one opening defined by a peripheral flange that is folded over against the surface of the plate adjacent the opening to secure the heat exchanger to the plate.

Expanders for joining a heat exchanger to a partition plate are disclosed in Hoeffken U.S. Pat. Nos. 4,538,338, 4,663,837 and 4,649,894, all assigned to the assignee of this invention. The high volume production requirement for heat exchanger and plate assemblies of the type described herein and in the Wiese and Hoeffken patents has created a need for a more effective and less expensive apparatus and method for assembling a clamshell type heat exchanger to a partition plate. In addition, apparatus must produce a joint that is leakproof, must accommodate variations in metal thicknesses, must function even though there be deformation in the metal, and must be efficient.

Although the expanders of the Hoeffken patents provided an effective means for securing a heat exchange unit to a plate member, these expanders require at least two pressing or bending steps. Moreover, the second bending step typically must be performed with a second expander having different jaw segments or different orientations of jaw segments. As noted in the Summary of the Invention of the '837 and '338 patents, with the expanders of those patents, "[T]he initial pressing operation is followed by insertion of a second expander apparatus to fully deform or fold portions of the flange which were not forcibly engaged by the jaws of the first apparatus." These auxiliary steps have been necessitated because voids naturally develop between the jaw segments of the expander as they are moved radially outward during the bending step. As a result, a single bending step has been found to leave portions of the wall surface at the joint displaced from the rim of the opening, and so the seal formed by the first bending step is incomplete.

Thus, to ensure a leakproof seal, after the initial bending step, a second expander is inserted into the opening in the plate and engaged with the flange to fully crimp or fold the flange in the noted spaced apart areas. The second expander has a set of jaws of a pattern different from that of the first expander, such that the jaws overlap the spaced apart flange areas which were not folded tight against the shoulder of the rim by the first expander. Accordingly, in the method utilizing the apparatus of the Hoeffken patents, jaw segments act directly on all portions of the wall surface. Portions not contacted by jaw segments during the first bending step are contacted by jaw segments during a second bending step. As a result, the procedures of the Hoeffken patents, although superior to the methods of other prior art, still are more cumbersome and time-consuming than desired.

SUMMARY OF THE INVENTION

The present invention provides an improved apparatus for manufacturing a heat exchanger and partition plate for gas fired hot air furnace structures wherein in a single crimping operation a substantially rigid joint is formed between one or more openings in a clamshell type heat exchanger and a partition plate.

In accordance with one aspect of the present invention an expander will form a pressed joint between a heat exchanger and a so-called partition plate or pouch plate wherein a peripheral flange formed about an opening in the plate is inserted into a corresponding opening in the heat exchanger and deformed or folded outwardly into engagement with the inner wall surface of a shoulder formed around the opening in the heat exchanger. In accordance with the invention the joint is formed around the opening by a multiple jaw press or expander apparatus which is inserted through the opening in the plate and the heat exchanger, followed by expansion of the jaws to carry out the folding or deforming process, and then retraction of the jaws to permit removal of the apparatus. The number of jaws of the apparatus is such that this single expander operation creates a substantially leakproof seal.

In accordance with another aspect of the present invention a substantially rigid pressed joint is formed between a plate member and a heat exchanger member at cooperating openings in both members by deforming a peripheral flange on the plate member into forcible engagement with the inner wall surface of a shoulder formed around the opening of the heat exchanger and wherein an axial movement of flange deforming jaws is carried out to assure that a leakproof joint is formed regardless of variations in metal thickness and other dimensional variations of the cooperating plate and heat exchanger parts. In this regard, the present invention also provides an improved apparatus for forming a rigid pressed joint between a heat exchanger and plate assembly. The expander or joint forming apparatus is adapted to be inserted through an opening in the plate member into the interior of the heat exchanger unit wherein a plurality of jaws are moved radially outward and then axially to forcibly engage and fold a seamless flange radially outward and into forcible engagement with a rim formed on the heat exchanger. The jaws are then retracted axially and radially to permit removal of the apparatus from the opening. The number of jaws of the apparatus is such that this single expander operation creates a substantially leakproof seal.

In accordance with still a further aspect of the present invention a pressed joint is formed at an opening in cooperating heat exchanger and supporting plate parts wherein a fold or deforming operation is carried out by jaws having die surfaces which curl the end of the flange of the partition plate to form a superior rigid pressed joint which will remain tight under substantial thermal stress imposed thereon in the operating environment of a gas fired hot air furnace.

Those skilled in the art of furnace heat exchanger assemblies including manufacturing methods and apparatus therefor will appreciate the above-noted features of the present invention as well as the improved manufacturing method together with additional superior aspects of the invention upon reading the detailed description which follows in conjunction with the drawings.

BRIEF DESCRIPTION OF THE DRAWINGS

FIG. 4 is a view in section taken along the plane of line 4—4 of FIG. 2;

FIG. 5 is a view in section taken along the plane of line 5—5 of FIG. 2;

FIG. 6 is an enlarged sectional view of the expander illustrating the right portion of what is shown in FIG. 2 together with portions of the heat exchanger and the partition plate and showing the expander in its preactuating condition;

FIG. 7 is an enlarged sectional view similar to that of FIG. 6 but showing the expander in an intermediate actuating condition;

FIG. 8 is an enlarged sectional view similar to that of FIG. 6 but showing the expander in its final actuating condition;

FIG. 9 is an enlarged partial sectional view of a portion of FIG. 6 showing the pre-expansion condition of the heat exchanger and partition plate components, corresponding to the condition of the expander illustrated in FIG. 6;

FIG. 10 is an enlarged partial sectional view similar to that of FIG. 9, but showing an intermediate condition of the heat exchanger and partition plate corresponding to the condition of expander illustrated in FIG. 7;

FIG. 11 is an enlarged partial sectional view similar to that of FIG. 6, but showing the final condition of the heat exchanger and partition plate corresponding to the condition of the expander illustrated in FIG. 8;

FIGS. 12 is an enlarged partial view in section taken along the plane of line 12—12 of FIG. 2;

FIG. 13 is a partial view in section taken along the plane of line 13—13 of FIG. 8;

FIG. 14 is an enlarged perspective view of a jaw segment;

FIG. 15 is an enlarged perspective view of a jaw segment generally opposite that of FIG. 14; and FIG. 16 is an inner side elevation view of a jaw segment.

DESCRIPTION OF THE PREFERRED EMBODIMENTS

Figures 1, 2, 3:
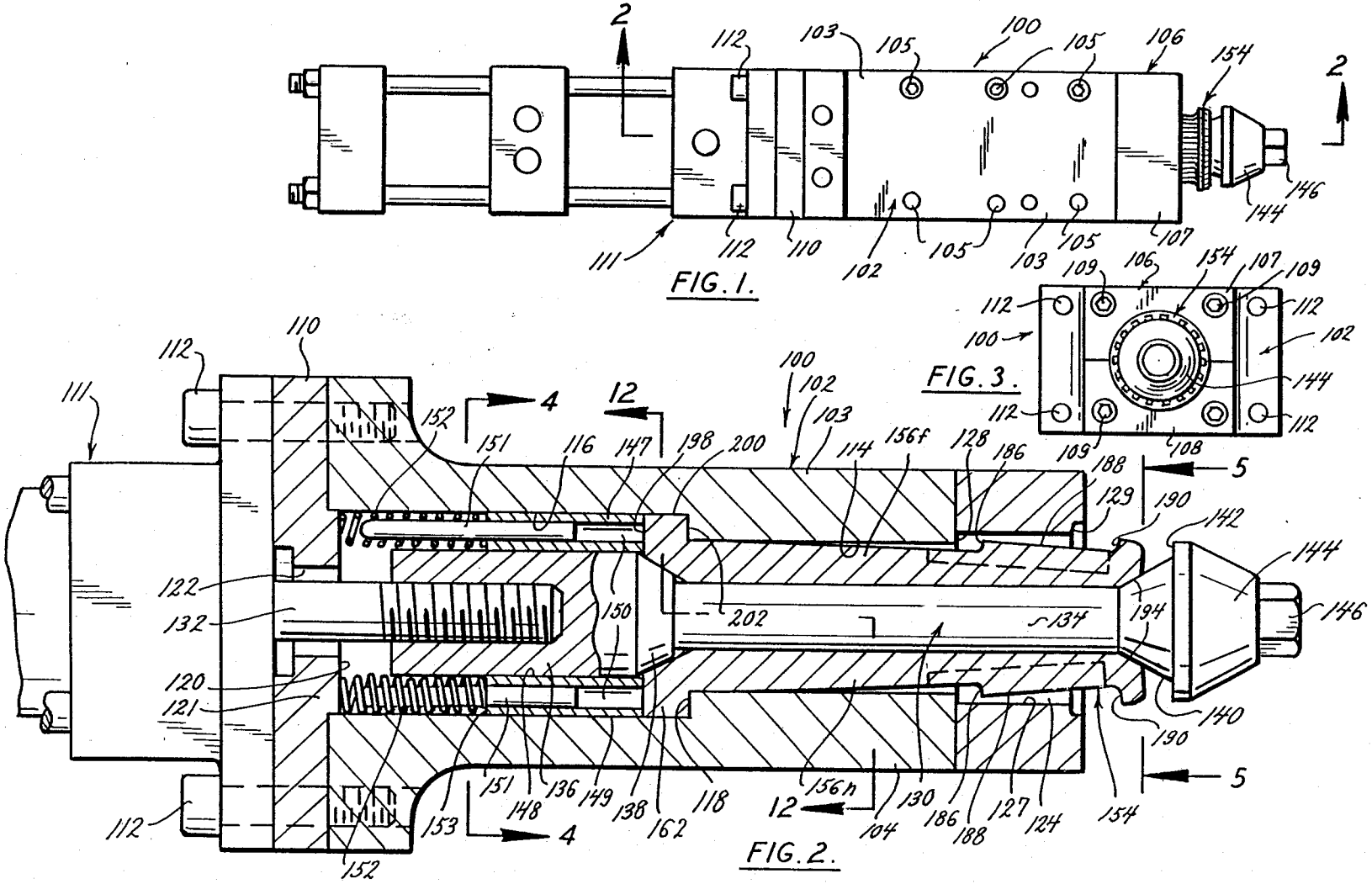
FIG. 1 is a side elevation of an expander for forming the pressed joint between a heat exchanger opening and a plate assembly.
FIG. 2 is an enlarged side elevation, partially sectioned along line 2—2 of FIG. 1.
FIG. 3 is a front end view of the expander as viewed from the right end of FIG. 1.

In the description which follows, like parts are marked throughout the specification and drawings with the same reference numerals, respectively. The drawings are not necessarily to scale and certain features of the invention may be shown exaggerated in scale or in somewhat schematic form in the interest of clarity and conciseness.

The expander is generally designated by the numeral 100 and comprises a body member 102 of separable complimentary body sections 103 and 104 is held together by suitable bolts 105. A nose section 106 comprises separable sections 107 and 108 fastened to the body number 102 by suitable bolts 109 (See FIG. 5). An end block 110 fits against the body member 102 and a hydraulic actuator assembly 111 is connected, with the end block 110, to the body member 102 by bolts 112. The hydraulic actuator assembly 111 is of known construction and functions as will be described.

The body member 102 has a cylindrical bore 114 through its forward portion and has a larger diameter bore 116 through its rearward portion. An annular radial shoulder 118 extends between the forward and rearward bores 114 and 116 and functions as a forward stop as will appear. The rearward end of the larger bore 116 is spanned by a face 120 on a hub 121 of the end cap 110 except for the area of a smaller hole 122 through the end cap 110. The hub 121 permits positive location of the end cap relative to the bore 116.

Forward of the body member 102, the nose section 106 has a plurality of longitudinal groves 124, each defined by parallel side walls 126 an outer wall 127. The outer walls 127 collectively segments of a cylinder of a diameter larger than that of the bore 114, exposing segments of an annular transverse wall 128. The forward ends of the outer walls 127 communicate with an annular seat 129 that has the annular concave shape illustrated in FIGS. 2 and 6–11.

A mandrel 130 is threaded to an axially movable piston 132 of the hydraulic actuator assembly 111. The mandrel 130 has a cylindrical shank 134 that extends through the bore 114 of the body member 102 and through the nose section 106. Rearward of the shank 134 is a larger cylindrical base section 136, and a frusto-conical curled surface 138 extends between the base section 136 and the shank 134.

Forward of the shank 134, there is an enlarging frusto-conical camming surface 140 the forward perimeter of which intersects a transverse annular driving wall 142 on the rearward side of a head 144. A hex head 146 is formed on the head 144 for installation and tightening of the mandrel 130 on the threaded piston 132.

A cylindrical spring block 147 has a cylindrical inner wall 148 surrounding the base section 136, and an outer wall 149 that contacts the bore 116. The spring block 147 can slide relative to the body 102 and the mandrel 130. The spring block has a plurality of pockets 150 in which dowels 151 are fixed, and a plurality of compression springs 152 are mounted on the dowels 151, bearing against the face 120 of the end cap 110 and the rear face 153 of the spring block 147.

A at least eight laminar jaw assembly 154 comprises a plurality of jaw segments **156*a*–156*r* installed circumferentially about the mandrel 130**. Although eighteen jaw segments are shown in the drawings it will be understood that the actual number of jaw segments may vary as will be discussed.

FIGS. 14–16 illustrate a typical jaw segment **156*a*, all of the jaw segments 14–16 being identical. The jaw segment 156*a* has an elongated body section 158 between a forward end 160 and a rearward end 162. The body section 158 has a curved inner face 164 complementary to the curved mandrel shank 134 and divergent side walls 166 and 168. The walls 166 and 168 diverge at an angle that puts adjacent jaw segments in close proximity or contact with one another when the inner faces 164 are in contact with the mandrel shank 134. Side wall sections 170 and 172 on the forward end 160 are coextensive with the side walls 166 and 168. There are side walls 174 and 176 on the rearward end. The side walls 166 and 168 have paralled flat sections 178 and 180 defining a body section 182 that fits closely but slideably within one of the grooves 124 in the nose section 106**.

The body 158 has an outer wall section 182 that is tapered inwardly as it extends forwardly from a line of intersection 184 with the rearward end 162. The tapered wall section 182 terminates at a transverse stop face 186 at the rearward end of another outer wall section 188. The wall section 188 is also tapered inwardly as it extends forwardly and it terminates at a concave crimping surface 190.

The front of the forward end 160 is defined by a flat transverse face 192. A curved inclined face 194 complementary to the curved camming surface 140 extends between the front face 192 and the inner face 164 and is adapted to slideably contact the annular camming wall 140.

At the rearward end 162 there is an inclined face 196 that can slide on the beveled surface 138. An end wall 198 is adapted to bear against the forward end of the spring block 147. The end wall 198 terminates at an outer wall 200 that slides against the bore 116. A transverse stop wall 202 extends between the outer wall 200 and the line of intersection 184 and is positioned to contact the annular radial shoulder 118 on the body 102.

This expander 100 is designed to provide a fluidtight connection between a heat exchanger 210 and a support panel 212 at an opening through them. Initially, the heat exchanger opening is defined by an annular flange 214 having a radial section 216 and an axial section 218, and the support panel opening is defined by a flange 220 having an outer axial section 222, a generally radial section 224 and an inner axial section 226. The operation of the expander to produce this connection will now be described.

OPERATION

In preparation, the heat exchanger 210 and support plate 212 are held (by means not shown) in the relative positions illustrated in FIGS. 6 and 9. In the unactuated condition illustrated in FIG. 2 the expander 100 is adapted to be inserted through the opening in the heat exchanger and in the support plate. Upon actuation of the hydraulic cylinder assembly 111, the mandrel 130 is drawn rearwardly or to the left as viewed in FIG. 2. As this occurs, the cooperating camming surfaces 140 and 194 between the mandrel and the respective jaw segments cause the forward ends 160 of the jaw segments to be moved radially outwardly. As the forward ends 160 of the jaw segments **156*a*–156*r* are forced outwardly by the annular camming surface 140, the jaw segments can, pivot adjacent their rearward ends 162 because of the inclined outer faces 182 and 188. During this outward movement, the jaw segments 156*a*–156*r* are guided to maintain radial paths of movement by their sliding contact within the longitudinal grooves 124. As the mandrel 130 is drawn from the position illustrated in FIG. 6 to the position illustrated in FIG. 7, the jaw segments 156*a*–156*r* are forced radially outwardly to positions at which the outer wall sections 188 contact the inner axial portions 226 of the partition wall 212. This positions the concave crimping or curling face 190 immediately in front of and radially outward of the axial flange section 226. Also, when the mandrel reaches the position illustrated in FIG. 7, its transverse annular wall 142 contacts the front walls 192 of the jaw segments. Thereafter, further rearward movement of the mandrel 130 will act through the wall 142 to push the jaw segments 156*a*–156*r* rearwardly, pushing the spring block 147 against the resistance of the springs 152**.

As the mandrel 130 is drawn from the position illustrated in FIG. 7 to the position illustrated in FIG. 8, the concave crimping face 190 approaches and engages the axial section 226 of the partition plate flange 220 and begins to curl it outwardly. Final movement of the mandrel rearwardly continues until the jaw segments **156*a*–156*r* have been forced rearward to the positions illustrated in FIGS. 8 and 11. This completely curls the flange 220 to the condition illustrated in FIG. 11 and crimps the heat exchanger flange 214 to the partition wall flange 220 in closely space segments. (Note that when the expander is cycled with no part in place, the annular wall 128 is contacted by the stop wall 186** to protect the expander from damage.)

Upon reverse actuation of the hydraulic cylindar assembly 111, the mandrel 130 is moved forwardly. During the initial portion of this forward movement, the springs 152 force the spring block 147 forwardly, pushing the jaw segments **156*a*–156*r* forwardly until their transverse walls 202 contact the annular stop wall 118. Thereafter, further forward movement of the mandrel 130 drives the camming surface 138 against the inclined walls 196 on the jaw segments, pivoting the inner races 164 of the jaws radially inwardly to the positions against the mandrel shaft 134 as illustrated in FIG. 2. The expander 100** is now in its initial condition ready for removal and insertion in the next heat exchange for another expanding operation.

Contrary to the results of the expander of the Hoeffken patents, in the operation of this expander 100, the radial outward movement of the jaw segments **156*a*–156*r* results in no areas between the jaw segments (designated as 144 in the Hoeffken patents) that are not folded tight and sealed. Accordingly, upon a single operation of the expander 100, the flange 220 is fully and continuously folded and crimped about the flange 214** and a second expander operation is not required.

The expander apparatus 100 is adapted to accommodate dimensional variations in the thickness of the flanges 214 and 220 due to the combined radial and axial movement of the jaw segments **156*a*–155*r*. Moreover, it has been found that separation between adjacent jaw segments during radially outward movement is of substantially reduced magnitude. Consequently, even though each jaw segment acts upon a relatively small portion of the perimeter of the opening, being crimped, the intermediate portions not directly contacted by the jaw segments are so narrow that they are tightly crimped during the initial and only expander operation. In addition, the expander of the present invention more effectively compensates and corrects for deformities in the metal being crimped. During expansion, if one jaw segment encounters a deformation in the part being manipulated, in many cases substantially the entire force being applied by retraction of the mandrel 130** is applied to that jaw segment and therefore that area of deformation until the deformed section conforms to the adjacent and surrounding material.

For this expander to operate effectively, a number of jaw segments must be incorporated such that a single movement of the jaw segments radially outward with respect to an axis and axially with respect to the axis bends the flange segment 226 into engagement with the heat exchanger unit to form a substantially continuous, rigid leakproof joint. It is believed that the minimum number of jaw segments necessary for this function will depend on the flange material and the shape and size of the opening. Nevertheless, it has been found that ordinarily substantially in excess of four and at least eight jaw segments are necessary for such effect and, by way of example, eighteen jaw segments are sufficient under typical circumstances. It also has been found that an apparatus of this invention made with eighteen jaw segments and of typical dimensions tends to have a maximum of about 0.06 inches of space between jaw segments when the apparatus is in an expanded condition, and that such gap is sufficiently small to enable formation of a substantially leakproof seal even in those portions of the flange material which were positioned at the gaps between the jaw segments. Thus, for illustration and not by way of of limitation, eighteen jaw segments are shown in the figures.

The improvements realized by the method and apparatus of the present invention will be recognized and appreciated by those skilled in the art, and it will be further recognized by those skilled in the art that various substitutions and modifications may be made to the specific embodiments described herein without departing from the scope and spirit of the invention as recited in the appended claims.

What I claim is:

1. An expander for use in securing a tubular heat exchanger unit to a plate member wherein:

said heat exchanger unit includes an opening through a wall of said heat exchanger unit and said plate member includes an opening corresponding to said opening in said heat exchanger unit and defined by a perimeter flange projecting from a plane of said plate member and said plate member is assembled with said heat exchanger unit by inserting said flange through said opening in said heat exchanger unit, and said apparatus comprises:

a plurality of at least eight flange engaging laminar jaw segments, each jaw segment having a concave shape for engaging a portion of the flange, a body member for supporting said flange engaging jaw segments for insertion through said openings in said plate member and said heat exchanger unit, means for moving said flange engaging jaw segments radially outward with respect to an axis and axially with respect to said axis to bend said flange into engagement with said heat exchanger unit about the perimeter of the opening and to compensate for variations of metal thickness of at least one of said flange and said wall to form a substantially rigid leakproof joint, and means for retracting said jaw segments, the number of flange engaging laminar jaw segments being such that a single sequence of movement of said flange engaging jaw segments radially outward with respect to an axis and axially with respect to said axis to bend said flange into engagement with said heat exchanger unit forms a substantially rigid leakproof joint.

2. The expander of claim 1 wherein the number of segments is at least about eighteen.

3. The expander as set forth in claim 1 including a mandrel surface means engageable with cooperating surface means on said jaw segments, means for moving said mandrel axially with respect to said jaw segments and means cooperable with said jaw segments to permit radial outward movement of said jaw segments by said mandrel followed by axial movement of said jaw segments by said mandrel to bend said flange into engagement with said wall.

4. The expander as set forth in claim 4 wherein said means cooperable with said jaw segments comprises yieldable means operably engageable with said jaw segments to permit said axial movement of said jaw segments by said mandrel to bend said flange after said jaw segments are moved radially outward by said mandrel.

5. The expander as set forth in claim 4 wherein said yieldable means comprises compression springs.

6. The expander as set forth in claim 1 wherein said body member defines a "continuous" substantially elliptical shaped engaging surface facing the engaging surfaces on said jaw segments, said means for moving the jaw segments axially with respect to said axis drawing the facing surfaces of said jaw segments and body member together to join the heat exchanger unit to said plate member.

7. An expander for use in securing a tubular heat exchanger unit to a plate member wherein:

said heat exchanger unit includes an opening into an interior chamber through a wall of said heat exchanger unit and said plate member includes an opening corresponding to said opening in said heat exchanger unit and defined by an perimeter flange projecting from a plane of said plate member and said plate member is assembled with said heat exchanger unit by inserting said flange through said opening in said heat exchanger unit, and said apparatus comprises:

a plurality of at least eight flange engaging laminar jaw segments, each jaw segment defining an engaging surface for engaging a portion of the flange, a body member for supporting said flange engaging jaw segments for insertion through said openings in said plate member and said heat exchanger unit, means for moving said flange engaging jaw segments radially outward with respect to an axis and axially with respect to said axis to bend said flange into engagement with said heat exchanger unit about the perimeter of the opening and to compensate for variations of metal thickness of at least one of said flange and said wall to form a substantially rigid leakproof joint, and means for retracting said jaw segments, the number of flange engaging laminar jaw segments being at least five and being such that a single sequence of movement of said flange engaging jaw segments radially outward with respect to an axis and axially with respect to said axis to bend said flange into engagement with said heat exchanger unit is sufficient to form a substantially rigid leakproof joint.

8. The expander set forth in claim 7 wherein the number of flange engaging jaw segments is at least about twelve.

9. The expander as set forth in claim 7 wherein said means cooperable with said jaw segments comprises yieldable means operably engageable with said jaw segments to permit said axial movement of said jaw segments by said mandrel to bend said flange after said jaw segments are moved radially outward by said mandrel.

10. The expander as set forth in claim 9 wherein said yieldable means comprises coil springs.

11. The expander as set forth in claim 7 wherein said body member defines a continuous substantially elliptical shaped engaging surface facing the engaging surfaces on said jaw segments, said means for moving jaw segments axially with respect to said axis drawing the facing surfaces of said jaw segments and body member together to join the heat exchanger unit to said plate member.

12. The expander of claim 7 wherein each jaw segment has diverging side walls and a section comprising parallel side wall sections, and a plurality of longitudinal grooves in the body member corresponding in number to the number of jaw segments, the parallel side wall sections being positioned within and slidiable with respect to the grooves to maintain equal distribution of the jaw segments about said axis.

13. A method for securing a tubular heat exchanger unit of a furnace to a plate member, comprising the steps of:

providing said heat exchanger unit as a relatively thin walled sheet metal structure defining a chamber for the flow of fluid to be in heat exchange relationship with the walls of said heat exchanger unit, said heat exchanger unit having at least one opening into said chamber through a wall of said heat exchanger unit and defined by a peripheral rim;

providing a plate member including an opening corresponding to said opening in said heat exchanger unit and defined by a perimeter flange projecting from the plane of said plate member;

inserting said flange into said chamber through said opening in said heat exchanger unit; and bending said flange radially outwardly and axially into engagement with an inner wall surface of said heat exchanger unit at the periphery of said opening and substantially without displacement of said rim to form a substantially rigid leakproof joint between said heat exchanger unit and said plate member;

the step of bending said flange being carried out using a tool including a plurality of at least eight radially expandable and contractable laminar jaw members, said method including the steps of inserting said tool through said opening in said plate member and into said chamber, actuating said jaw members to move radially outward into engagement with portions of said flange, moving said jaw members axially to bend said flange into engagement with said heat exchanger unit, contracting said jaw members radially inwardly, and removing said tool from said opening in said plate member, the number of flange engaging jaw segments being such that a single sequence of said flange engaging jaw segments radially outward with respect to an axis and axially with respect to said axis to bend said flange into engagement with said heat exchanger unit forms a substantially rigid leakproof joint.

14. The method set forth in claim 13 wherein:

the step of bending said flange includes curling the distal end of said flange with said surface means on said jaw members.

15. An expander comprising:

a body, an opening through the body, a mandrel movable axially through the opening, a plurality of at least eight laminar jaw segments extending axially within the opening and positioned circumferentially about the mandrel, the body having a crimping area on the body surrounding the opening, the jaw segments having complementary crimping areas, means on the mandrel for moving the jaws "radially outwardly and thereafter" axially upon movement of the mandrel in an axial direction to move the complementary jaw crimping areas toward the body crimping area for crimping two metal components together in a fluid-tight connection about an opening, the jaw segments being of sufficient number to minimize the space between adjacent jaw segments upon said radially outward movement of the jaw segments whereby a single operation of the expander produces a fluid-tight seal between the two metal components about the entire perimeter of the opening.

16. The expander of claim 15 including radially extending guide means in the body for restricting each jaw segment to movement in substantially a single radial plane.

17. The expander of claim 15 including spring means for biasing the jaw segment axially opposite said axial direction.

18. The expander of claim 15 wherein there are at least twelve jaw segments.

19. The expander of claim 15 wherein there are about eighteen jaw segments.

* * * * *